US011391163B1

(12) United States Patent
Liles et al.

(10) Patent No.: US 11,391,163 B1
(45) Date of Patent: Jul. 19, 2022

(54) VANE ARC SEGMENT WITH SEAL

(71) Applicant: RAYTHEON TECHNOLOGIES CORPORATION, Farmington, CT (US)

(72) Inventors: Howard J. Liles, Newington, CT (US); Robert A. White, III, Meriden, CT (US); Jon E. Sobanski, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/193,343

(22) Filed: Mar. 5, 2021

(51) Int. Cl.
*F01D 5/18* (2006.01)
*F01D 9/04* (2006.01)

(52) U.S. Cl.
CPC ..... *F01D 5/187* (2013.01); *F01D 5/188* (2013.01); *F01D 9/041* (2013.01); *F05D 2240/126* (2013.01); *F05D 2260/201* (2013.01)

(58) Field of Classification Search
CPC ..... F01D 5/187; F01D 5/188; F01D 9/041; F05D 2260/201; F05D 2240/126
See application file for complete search history.

(56) References Cited

U.S. PATENT DOCUMENTS

| | | | | |
|---|---|---|---|---|
| 6,464,456 | B2 * | 10/2002 | Darolia | F01D 5/3084 415/209.2 |
| 7,452,189 | B2 * | 11/2008 | Shi | F01D 5/147 416/241 B |
| 9,556,750 | B2 | 1/2017 | Freeman et al. | |
| 10,094,239 | B2 | 10/2018 | Freeman et al. | |
| 11,008,888 | B2 * | 5/2021 | Sippel | F01D 9/042 |
| 2002/0127097 | A1 * | 9/2002 | Darolia | F01D 5/3084 415/137 |
| 2016/0376899 | A1 | 12/2016 | Prugarewicz et al. | |
| 2020/0025025 | A1 * | 1/2020 | Sippel | F01D 9/065 |

* cited by examiner

*Primary Examiner* — Eldon T Brockman
(74) *Attorney, Agent, or Firm* — Carlson, Gaskey & Olds, P.C.

(57) ABSTRACT

A vane arc segment includes an airfoil wall that defines first and second fairing platforms and a hollow airfoil section. A spar leg extends through the hollow airfoil section and has an end portion that protrudes from the hollow airfoil section. The spar leg is spaced from the airfoil wall in the hollow airfoil section such that there is a first gap. There is a support platform adjacent the second airfoil fairing and a second gap therebetween. A baffle is disposed in the first gap and is spaced apart from the airfoil wall and the spar leg so as to divide the first gap into a plenum space between the spar leg and the baffle and an impingement space between the baffle and the airfoil wall. A seal is disposed between the airfoil wall and the spar leg to seal the impingement space from the second gap.

20 Claims, 5 Drawing Sheets

VANE ARC SEGMENT WITH SEAL

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A vane arc segment according to an example of the present disclosure includes an airfoil fairing that has an airfoil wall defining first and second fairing platforms and a hollow airfoil section extending there between. A spar has a spar leg that extends through the hollow airfoil section. The spar leg has an end portion that protrudes from the hollow airfoil section. The spar leg is spaced from the airfoil wall in the hollow airfoil section such that there is a first gap there between. A support platform is adjacent the second fairing platform such that there is a second gap there between. The support platform is secured with the end portion of the spar leg. A baffle is disposed in the first gap. The baffle is spaced apart from the airfoil wall and the spar leg so as to divide the first gap into a plenum space between the spar leg and the baffle and an impingement space between the baffle and the airfoil wall. The baffle has impingement holes directed toward the airfoil wall and connects the plenum space with the impingement space. A seal is disposed between the airfoil wall and the spar leg. The seal seals the impingement space from the second gap.

In a further embodiment of any of the foregoing embodiments, the seal is a rope seal.

In a further embodiment of any of the foregoing embodiments, the seal is radially offset from the baffle.

In a further embodiment of any of the foregoing embodiments, the spar leg includes a scallop and the seal is seated against the scallop.

In a further embodiment of any of the foregoing embodiments, the spar leg includes a protrusion that has a weld land at which the baffle is welded thereto, and the seal is radially offset from the protrusion.

In a further embodiment of any of the foregoing embodiments, the seal seats against the baffle.

In a further embodiment of any of the foregoing embodiments, the support platform includes a radially upstanding lip against which the seal seats.

In a further embodiment of any of the foregoing embodiments, the radially upstanding lip is adjacent the baffle and includes at least one through-hole connecting the plenum space and the second gap.

In a further embodiment of any of the foregoing embodiments, the radially upstanding lip includes a shank portion and a cup portion, the seal seating in the cup portion.

In a further embodiment of any of the foregoing embodiments, the radially upstanding lip includes a shank portion and a band portion, and the band portion wraps around the seal.

In a further embodiment of any of the foregoing embodiments, the hollow airfoil section includes first and second cavities, the spar leg extends through the first cavity, and there is an additional baffle disposed in the second cavity, with an additional seal disposed between the airfoil wall and the additional baffle. The additional seal seals the second cavity from the second gap.

A gas turbine engine according to an example of the present disclosure includes compressor section, a combustor in fluid communication with the compressor section, and a turbine section in fluid communication with the combustor. The turbine section has vane arc segments disposed about a central axis of the gas turbine engine. Each of the vane arc segments includes an airfoil fairing has an airfoil wall defining first and second fairing platforms and a hollow airfoil section that extends there between. A spar has a spar leg that extends through the hollow airfoil section. The spar leg has an end portion that protrudes from the hollow airfoil section. The spar leg is spaced from the airfoil wall in the hollow airfoil section such that there is a first gap there between. A support platform is adjacent the second fairing platform such that there is a second gap there between. The support platform is secured with the end portion of the spar leg. A baffle is disposed in the first gap. The baffle is spaced apart from the airfoil wall and the spar leg so as to divide the first gap into a plenum space between the spar leg and the baffle and an impingement space between the baffle and the airfoil wall. The baffle has impingement holes directed toward the airfoil wall and connect the plenum space with the impingement space. A seal is disposed between the airfoil wall and the spar leg. The seal seals the impingement space from the second gap.

In a further embodiment of any of the foregoing embodiments, the seal is a rope seal and is radially offset from the baffle.

In a further embodiment of any of the foregoing embodiments, the spar leg includes a scallop and the seal is seated against the scallop.

In a further embodiment of any of the foregoing embodiments, the spar leg includes a protrusion that has a weld land at which the baffle is welded thereto, and the seal is radially offset from the protrusion.

In a further embodiment of any of the foregoing embodiments, the seal seats against the baffle.

In a further embodiment of any of the foregoing embodiments, the support platform includes a radially upstanding lip against which the seal seats.

In a further embodiment of any of the foregoing embodiments, the radially upstanding lip is adjacent the baffle and includes at least one through-hole connecting the plenum space and the second gap.

In a further embodiment of any of the foregoing embodiments, the radially upstanding lip includes a shank portion and a cup portion, the seal seating in the cup portion.

In a further embodiment of any of the foregoing embodiments, the radially upstanding lip includes a shank portion and a band portion. The band portion wraps around the seal.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
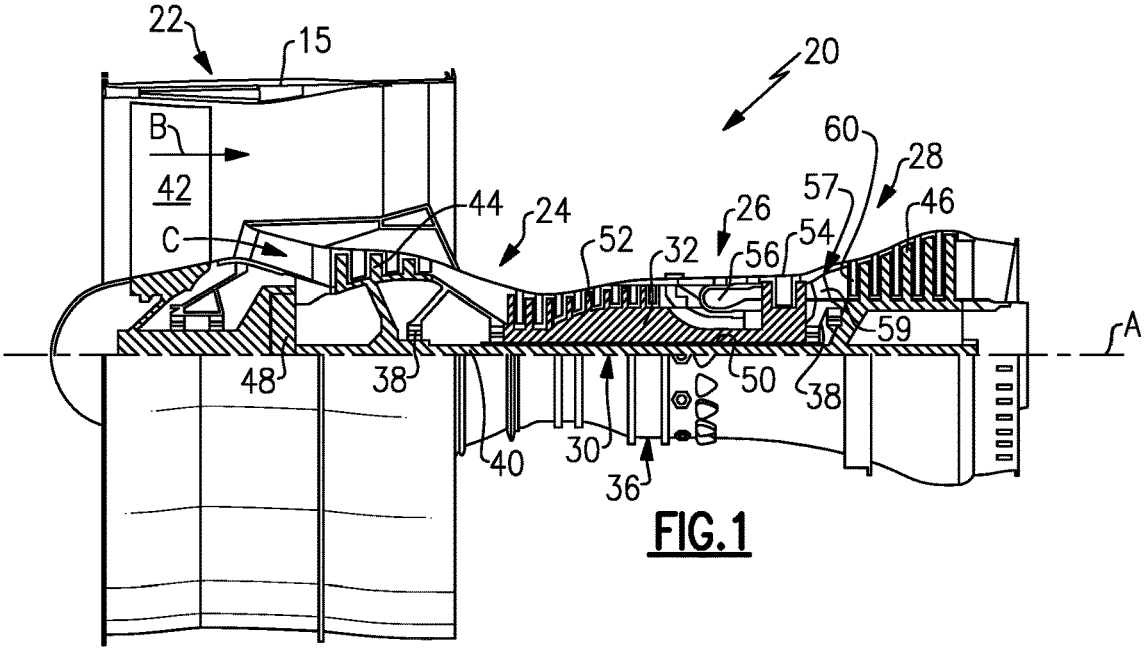
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
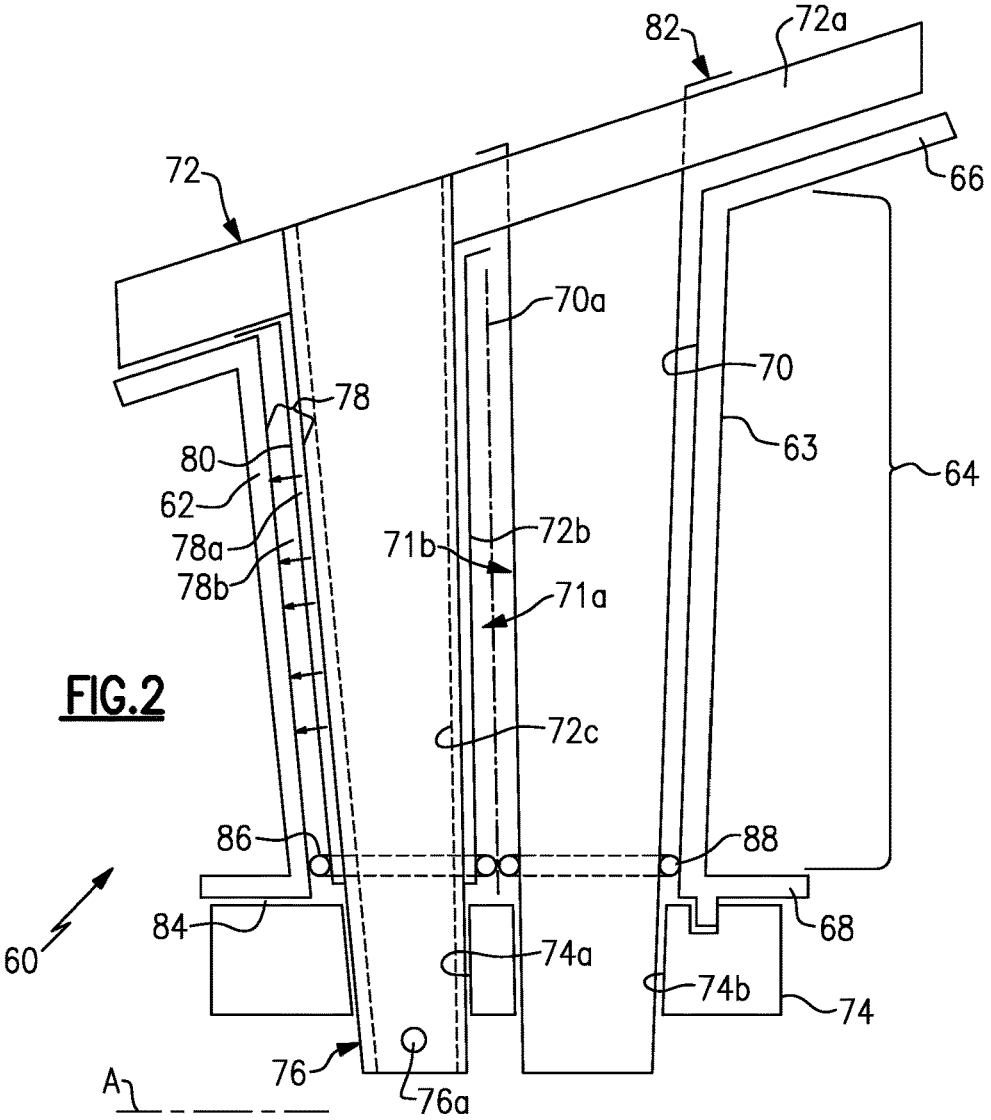
FIG. 2 illustrates a vane arc segment from the engine.

FIG. 2 illustrates a line representation of an example of a vane arc segment 60 from the turbine section 28 of the engine 20 (see also FIG. 1). It is to be understood that although the examples herein are discussed in context of a vane from the turbine section, the examples can be applied to vanes in other portions of the engine 20.

The vane arc segment 60 includes an airfoil fairing 62 that is formed by an airfoil wall 63. The airfoil fairing 62 is comprised of a hollow airfoil section 64 and first and second platforms 66/68 between which the airfoil section 64 extends. The airfoil section 64 generally extends in a radial direction relative to the central engine axis A. Terms such as "inner" and "outer" used herein refer to location with respect to the central engine axis A, i.e., radially inner or radially outer. Moreover, the terminology "first" and "second" used herein is to differentiate that there are two architecturally distinct components or features. It is to be further understood that the terms "first" and "second" are interchangeable in that a first component or feature could alternatively be termed as the second component or feature, and vice versa.

The airfoil wall 63 is continuous in that the platforms 66/68 and airfoil section 64 constitute a unitary body. As an example, the airfoil wall 63 is formed of a ceramic matrix composite, an organic matrix composite (OMC), or a metal matrix composite (MMC) or homogeneous polymer, metallic or ceramic material. For instance, the ceramic matrix composite (CMC) is formed of ceramic fiber tows that are disposed in a ceramic matrix. The ceramic matrix composite may be, but is not limited to, a SiC/SiC ceramic matrix composite in which SiC fiber tows are disposed within a SiC matrix. Example organic matrix composites include, but are not limited to, glass fiber tows, carbon fiber tows, and/or aramid fiber tows disposed in a polymer matrix, such as epoxy. Example metal matrix composites include, but are not limited to, boron carbide fiber tows and/or alumina fiber tows disposed in a metal matrix, such as aluminum. A fiber tow is a bundle of filaments. As an example, a single tow may have several thousand filaments. The tows may be arranged in a fiber architecture, which refers to an ordered arrangement of the tows relative to one another, such as, but not limited to, a 2D woven ply or a 3D structure.

The airfoil section 64 circumscribes an interior cavity 70, which in this example is subdivided by a rib 70*a* into first and second sub-cavities 71*a*/71*b*. Alternatively, the airfoil section 64 may have a single cavity 70, or the cavity 70 may be divided by additional ribs. The vane arc segment 60 further includes a spar 72 that mechanically supports the airfoil fairing 62. The spar 72 includes a spar platform 72*a* and a spar leg 72*b* that extends from the spar platform 72*a* into the cavity 70 (through the first sub-cavity 71*a*). Although not shown, the radially outer side of the spar platform 72*a* may include attachment features that secure it to a fixed support structure, such as an engine case. The spar leg 72*b* defines an interior through-passage 72*c*.

The end of the spar leg 72*b* extends past the platform 68 so as to protrude from the fairing 62. There is a support platform 74 adjacent the platform 68 of the airfoil fairing 62. The support platform 74 includes a first through-hole 74*a* through which the end of the spar leg 72*b* extends. In this example, the end of the spar leg 72*b* includes a clevis mount 76, although other mounting schemes could alternatively be used. The clevis mount 76 may include one or more prongs that protrude from the support platform 74. The prong or prongs include a pinhole through which a pin 76*a* extends. The pin 76*a* is wider than the through-hole 74*a* of the support platform 74. The ends of the pin 76*a* thus abut the face of the support platform 74 and thereby prevent the spar leg 72*b* from being retracted from the through-hole 74*a*. The pin 76*a* thus locks the support platform 74 to the spar leg 72*b* such that the airfoil fairing 62 is mechanically trapped between the spar platform 72*a* and the support platform 74. It is to be appreciated that the example configuration could be used at the outer end of the airfoil fairing 62, with the spar 72 being inverted such that the spar platform 72*a* is adjacent the (inner) platform 68 and the support platform 74 is adjacent the (outer) platform 66. The spar 72 may be formed of a relatively high temperature resistance, high strength material, such as a single crystal metal alloy (e.g., a single crystal nickel- or cobalt-alloy).

The spar leg 72*b* is spaced from the airfoil wall 63 such that there is a first gap 78 there between. The walls of the spar leg 72*b* are solid and continuous. There is a baffle 80 disposed in the gap 78. The baffle 80 generally circumscribes the spar leg 72*b*. The baffle 80 is spaced apart from the airfoil wall 63 and the spar leg 72*b* so as to divide the gap 78 into a plenum space 78*a* between the spar leg 72*b* and the baffle 80 and an impingement space 78*b* between the baffle 80 and the airfoil wall 63. The baffle 80 has impingement holes (represented at unnumbered flow arrows) that are directed toward the airfoil wall 63 and connect the plenum space 78*a* and the impingement space 78*b*. The baffle 80 is formed of sheet metal but may alternatively be formed from an alloy using additive manufacturing.

The baffle 80 may not extend entirely through the airfoil section 62 to the support platform 74. Rather, the end of the baffle 80 is joined to the spar leg 72*b* prior to the clevis mount 76. In this regard, the impingement holes in the baffle 80 may be the exclusive exit from the plenum space 78*a* into the impingement space 78*b*.

Cooling air, such as bleed air from the compressor section 24, is conveyed into and through the through-passage 72*c*. This cooling air is destined for a downstream cooling location, such as a tangential onboard injector (TOBI). Cooling air is also conveyed into the plenum space 78*a*. The cooling air in the plenum space 78*a* is emitted through the impingement holes in the baffle 80 onto the airfoil wall 63 for cooling thereof.

In the illustrated example, there is an additional, second baffle 82 that extends through the second sub-cavity 71*b*. The baffle 82 is also provided with cooling air and may have cooling holes therein for directing the cooling air at portions of the airfoil wall 63. In this example, like the spar leg 72*b*, the baffle 82 protrudes from the airfoil fairing 62 and through a second through-hole 74*b* in the support platform 74.

The support platform 74 is radially spaced from the platform 68 of the airfoil fairing 62 such that there is a second gap 84 there between. There is a first seal 86 disposed between the airfoil wall 63 and the spar leg 72*b*. The seal 86 seals the impingement space 78*b* from the second gap 84 such that cooling air in the impingement space 78*b* cannot escape into the second gap 84. There is a second seal 88 disposed between the airfoil wall 63 and the baffle 82. The seal 88 seals the space in the second sub-cavity 71*b* between the baffle 82 and the airfoil wall 63 from the second gap 84 such that cooling air in the second sub-cavity 71*b* cannot escape into the second gap 84. Alternatively, if the second gap 84 is pressurized, the seals 86/88 prevent flow from the second gap 84 into the sub-cavities 71*a*/71*b*.

In a further example, the seals 86/88 are rope seals. For example, the rope seals are formed of fibers, such as ceramic fibers, metallic fibers, graphite fibers, or polymer fibers. The fibers may be braided, knitted, or woven. Example ceramic fibers include, but are not limited to, oxide fibers. For instance, the ceramic fibers are NEXTEL fibers, which are composed of $Al_2O_3$, $SiO_2$, and $B_2O_3$. Example metallic fibers include, but are not limited to, nickel alloy or a cobalt alloy fibers. Example polymer fibers include, but are not limited to, meta-aramid or para-aramid fibers. For instance, the polymer fibers are NOMEX fibers, which are composed of m-phenylenediamine isophthalamide. Optionally, the rope seals may include a sheath surrounding a fiber core. The sheath can be an overbraid or foil that surrounds the core. In one example, the sheath comprises a high-temperature metallic material, such as a single crystal nickel alloy or a cobalt alloy. For instance, in the overbraid example, the sheath comprises an overbraid of metallic wire. In other examples, the sheath comprises a ceramic-based material.

Figure 3:
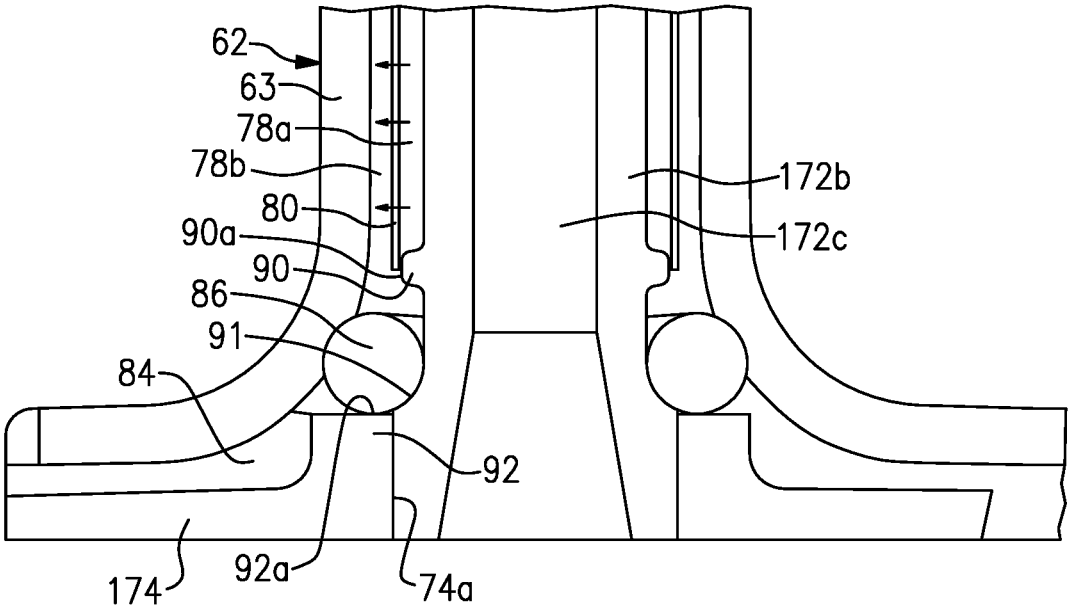
FIG. 3 illustrates a seal between a spar leg and an airfoil fairing of the vane arc segment.

FIG. 3 illustrates a further example in which the support platform 174 and spar leg 172*b* are configured to facilitate positioning of the seal 86. In this disclosure, like reference numerals designate like elements where appropriate and reference numerals with the addition of one-hundred or multiples thereof designate modified elements that are understood to incorporate the same features and benefits of the corresponding elements. Here, the spar leg 172*b* includes a protrusion 90 that extends around the periphery of the spar leg 172*b*. The protrusion has a weld land 90*a* at which the end of the baffle 80 is welded to. The spar leg 172*b* further includes a scallop 91 that is radially offset from the protrusion 90. The scallop 91 is a sloped portion of the spar leg 172*b* that curves outwards. The curvature of the scallop 91 provides a seat against which the seal 86 is positioned (the seal 86 is thus radially offset from the protrusion 90). The curvature cradles the seal 86 and thereby serves to keep the seal 86 from shifting radially inwards (toward the support platform 174). The protrusion 90 serves to keep the seal from shifting radially outwards.

The support platform 174 in the illustrated example also includes a radially upstanding lip 92. The lip 92 extends around the periphery of the first through-hole 74*a* of the support platform 174. The lip 92 includes a radially-facing surface 92*a* against which the seal 86 seats. The lip 92 further prevents the seal 86 from shifting radially (inwards in this example).

Figure 4:
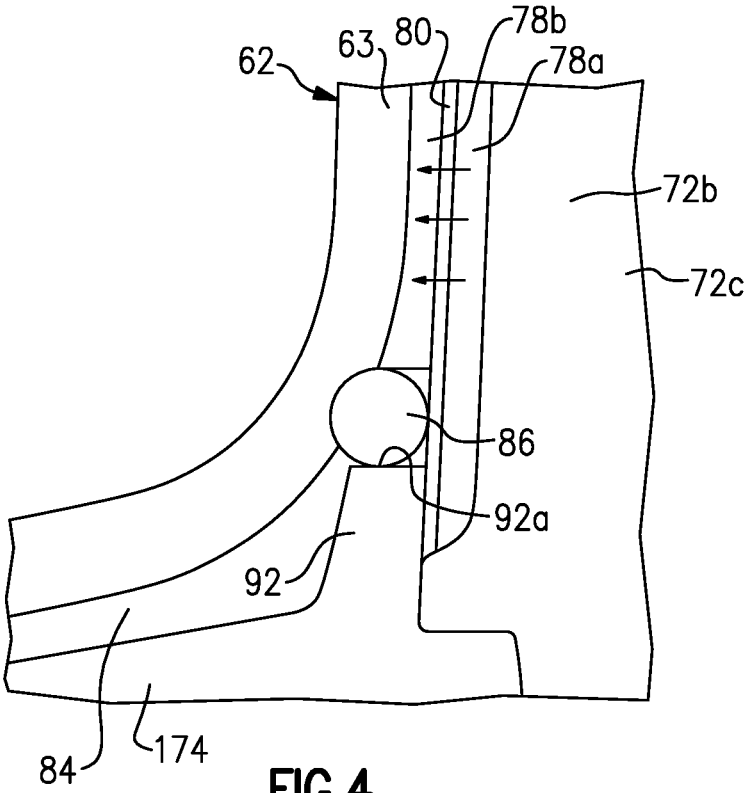
FIG. 4 illustrates another example in which the seal seats against a baffle adjacent the spar leg and is supported by a radially upstanding lip.

In the example of FIG. 3, the seal 86 seals against the airfoil wall 63 and the spar leg 172*b*. FIG. 4 illustrates a modified configuration in which the baffle 80 extends radially farther (inwards) such that the seal 86 seals against the airfoil wall 63 and the surface of the baffle 80.

Figure 5:
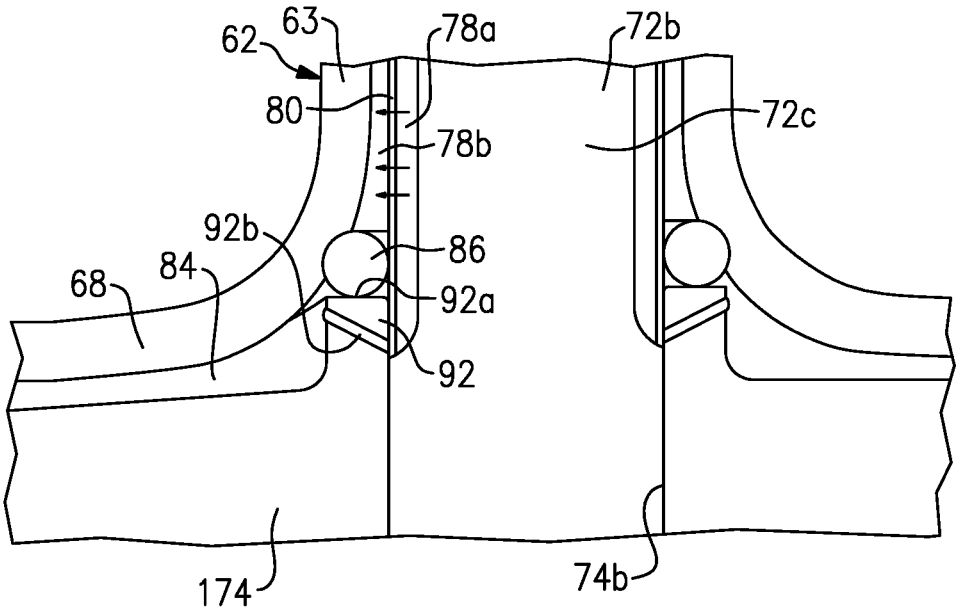
FIG. 5 illustrates another example in which a radially upstanding lip has one or more through-holes for cooling.

FIG. 5 illustrates a further example that is the same as the example of FIG. 4 except that the lip 92 includes one or more through-holes 92*b* that connect the plenum space 78*a* and the second gap 84. Cooling air from the plenum space 78*a* is emitted through the cooling hole(s) 92*b* toward the fillet, platform 68, and/or airfoil section 64 of the fairing 62. As shown, the cooling hole(s) 92*b* may be sloped (relative to the engine axis A) such that the cooling air impinges on the fillet region or other regions which are susceptible to extreme temperatures.

Figure 6:
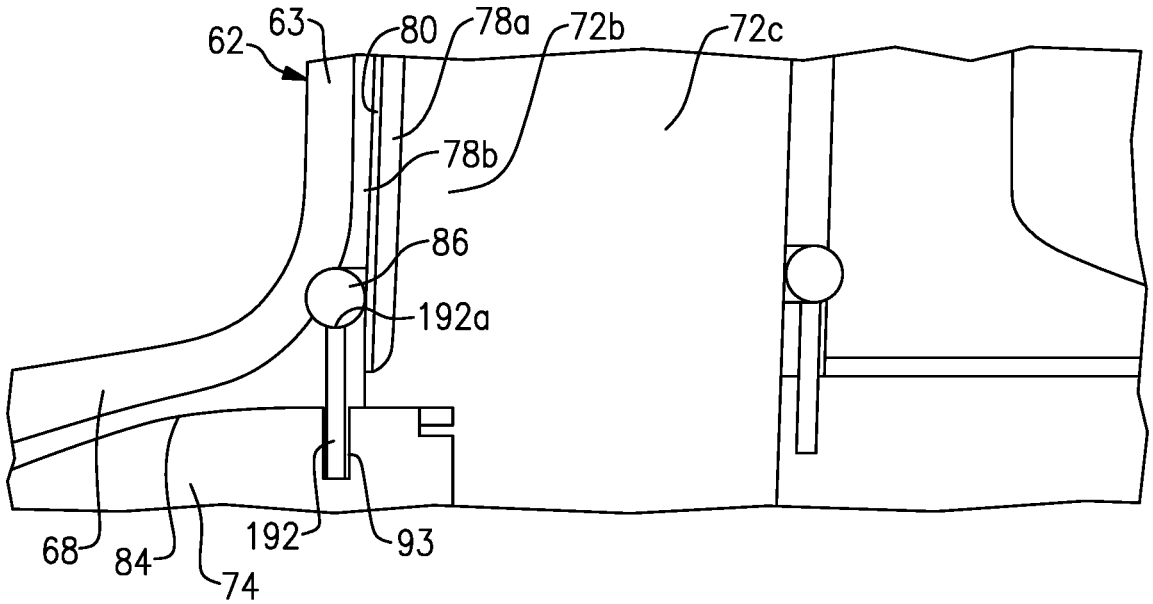
FIG. 6 illustrates another example in which there is a separable radially upstanding lip.

In the example of FIG. 4, the radially upstanding lip 92 is integral with the support platform 174. FIG. 6 illustrates an additional example in which the support platform 74 has a separable radially upstanding lip 192. For instance, the lip 192 is a separate piece from the body of the support platform 74. In this regard, the support platform 74 includes a slot 93 into which a portion of the lip 192 is received. the slot 93 facilitates retaining and positioning the lip 192. Like the lip 92, the lip 192 includes a radially-facing surface 192*a* against which the seal 86 seats to prevent the seal 86 from shifting radially (inwards in this example).

Figure 7:
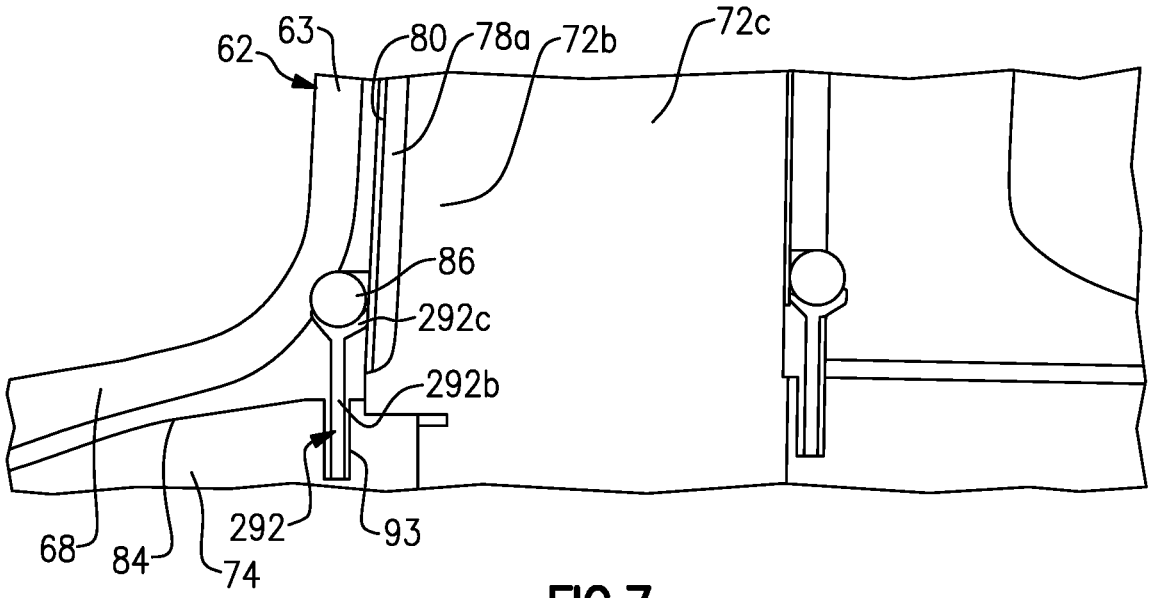
FIG. 7 illustrates another example in which the separable radially upstanding lip has a cup portion.

The example in FIG. 7 is the same as in FIG. 6 except that here the separable radially upstanding lip 292 has a shank portion 292*b* and a cup portion 292*c*. The shank portion 292*b* is received into the slot 93. The cup portion 292*c* is located at the radial end of the shank portion 292*b*. The cup portion 292*c* is curved and the seal 86 is seated against the curved surface of the cup portion 292*c* to retain and position the seal 86 in place.

Figure 8A:
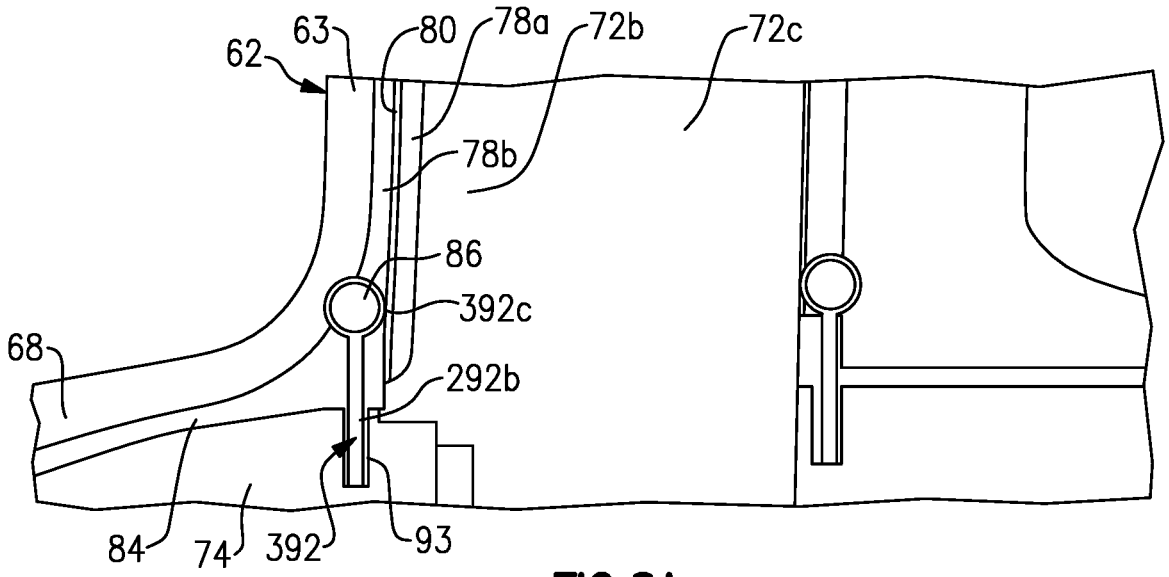
FIG. 8A illustrates another example in which the separable radially upstanding lip has a band portion.

The example in FIG. 8A is the similar to the example of FIG. 7 except that here instead of a cup portion the separable radially upstanding lip 392 has a band portion 392*c*. The shank portion 292*b* is received into the slot 93. The band portion 392*c* is located at the radial end of the shank portion 292*b*. The band portion 392*c* wraps around the seal 86 to retain and position the seal 86 in place. The band portion 392*c* may initially be "open" so as to enable the seal 86 to be received therein, and then subsequently bent to wrap around the seal 86.

Figure 8B:
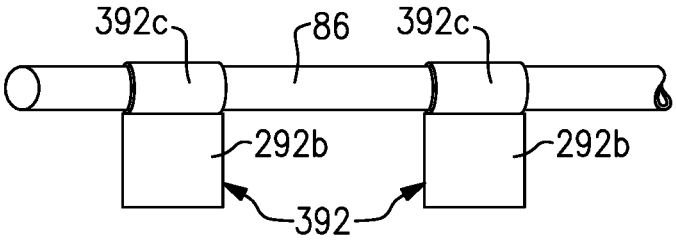
FIG. 8B illustrates another example in which the band portions are at spaced intervals along the seal.

The shank portion 292*b* and band portion 392*c* may be coextensive with the seal 86 or provided at intervals along the seal 86. For example, as shown in FIG. 8B, the shank portion 292*b* and band portion 392*c* are provided at spaced intervals along the seal 86. The portion of the seal 86 between the band portions 392*c* is not directly supported by the shank portion 292*b* and the band portion 392*c*, however, the intervals may be relatively close together to facilitate the elimination of sagging of the seal 86 there between.

Figure 9:
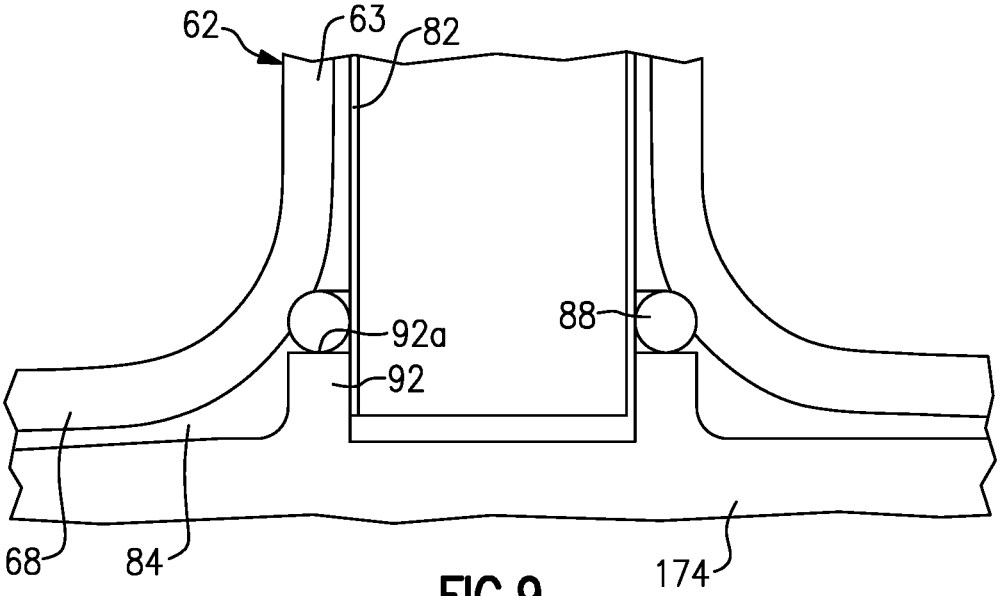
FIG. 9 illustrates a support platform that includes a radially upstanding lip.

As mentioned above, the seal 88 seals the space in the second sub-cavity 71*b* between the baffle 82 and the airfoil wall 63 from the second gap 84 such that cooling air in the second sub-cavity 71*b* cannot escape into the second gap 84. As shown in FIG. 9, the support platform 174 may include an additional radially upstanding lip 92 around the periphery of the second through-hole 74*b* of the support platform 174 to support the seal 88. Additionally, similar to the spar leg 72*b*, the baffle 82 may have a scallop to further facilitate positioning.

As indicated, the seals 86/88 facilitate sealing from the second gap 84. In particular, sealing against composite materials that form the airfoil fairing 62 is challenging because such composites may have higher surface roughness in comparison to traditional metallic alloy surfaces that are machined. Rope seals, which are flexible and conform to surface contours, facilitate sealing against such surfaces but must be maintained in proper position. In this regard, the seals 86/88 are trapped between the airfoil fairing 62, the support platform 74/174 and the respective spar leg 72*b* or baffle 82. One or more spring members may be provided between the platform 66 of the airfoil fairing 62 and the spar platform 72*a* to bias the airfoil fairing towards the support platform 74/174. Such a biasing facilitates providing a constant clamping force of the airfoil fairing 62 against the seals 86/88 to thereby further maintain position of the seals 86/88.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A vane arc segment comprising:

an airfoil fairing having an airfoil wall defining first and second fairing platforms and a hollow airfoil section extending there between;

a spar having a spar leg that extends through the hollow airfoil section, the spar leg having an end portion that protrudes from the hollow airfoil section, the spar leg being spaced from the airfoil wall in the hollow airfoil section such that there is a first gap there between;

a support platform adjacent the second fairing platform such that there is a second gap there between, the support platform being secured with the end portion of the spar leg;

a baffle disposed in the first gap, the baffle being spaced apart from the airfoil wall and the spar leg so as to divide the first gap into a plenum space between the spar leg and the baffle and an impingement space between the baffle and the airfoil wall, the baffle having impingement holes directed toward the airfoil wall and connecting the plenum space with the impingement space; and a seal disposed between the airfoil wall and the spar leg, the seal sealing the impingement space from the second gap.

2. The vane arc segment as recited in claim 1, wherein the seal is a rope seal.

3. The vane arc segment as recited in claim 1, wherein the seal is radially offset from the baffle.

4. The vane arc segment as recited in claim 1, wherein the spar leg includes a scallop and the seal is seated against the scallop.

5. The vane arc segment as recited in claim 1, wherein the spar leg includes a protrusion that has a weld land at which the baffle is welded thereto, and the seal is radially offset from the protrusion.

6. The vane arc segment as recited in claim 1, wherein the seal seats against the baffle.

7. The vane arc segment as recited in claim 1, wherein the support platform includes a radially upstanding lip against which the seal seats.

8. The vane arc segment as recited in claim 7, wherein the radially upstanding lip is adjacent the baffle and includes at least one through-hole connecting the plenum space and the second gap.

9. The vane arc segment as recited in claim 7, wherein the radially upstanding lip includes a shank portion and a cup portion, the seal seating in the cup portion.

10. The vane arc segment as recited in claim 7, wherein the radially upstanding lip includes a shank portion and a band portion, the band portion wrapping around the seal.

11. The vane arc segment as recited in claim 1, wherein the hollow airfoil section includes first and second cavities, the spar leg extends through the first cavity, and there is an additional baffle disposed in the second cavity, with an additional seal disposed between the airfoil wall and the additional baffle, the additional seal sealing the second cavity from the second gap.

12. A gas turbine engine comprising:

a compressor section;

a combustor in fluid communication with the compressor section; and a turbine section in fluid communication with the combustor, the turbine section having vane arc segments disposed about a central axis of the gas turbine engine, each of the vane arc segments includes:

an airfoil fairing having an airfoil wall defining first and second fairing platforms and a hollow airfoil section extending there between, a spar having a spar leg that extends through the hollow airfoil section, the spar leg having an end portion that protrudes from the hollow airfoil section, the spar leg being spaced from the airfoil wall in the hollow airfoil section such that there is a first gap there between, a support platform adjacent the second fairing platform such that there is a second gap there between, the support platform being secured with the end portion of the spar leg, a baffle disposed in the first gap, the baffle being spaced apart from the airfoil wall and the spar leg so as to divide the first gap into a plenum space between the spar leg and the baffle and an impingement space between the baffle and the airfoil wall, the baffle having impingement holes directed toward the airfoil wall and connecting the plenum space with the impingement space, and a seal disposed between the airfoil wall and the spar leg, the seal sealing the impingement space from the second gap.

13. The gas turbine engine as recited in claim 12, wherein the seal is a rope seal and is radially offset from the baffle.

14. The gas turbine engine as recited in claim 12, wherein the spar leg includes a scallop and the seal is seated against the scallop.

15. The gas turbine engine as recited in claim 12, wherein the spar leg includes a protrusion that has a weld land at which the baffle is welded thereto, and the seal is radially offset from the protrusion.

16. The gas turbine engine as recited in claim 12, wherein the seal seats against the baffle.

17. The gas turbine engine as recited in claim 12, wherein the support platform includes a radially upstanding lip against which the seal seats.

18. The gas turbine engine as recited in claim 17, wherein the radially upstanding lip is adjacent the baffle and includes at least one through-hole connecting the plenum space and the second gap.

19. The gas turbine engine as recited in claim 17, wherein the radially upstanding lip includes a shank portion and a cup portion, the seal seating in the cup portion.

20. The gas turbine engine as recited in claim 17, wherein the radially upstanding lip includes a shank portion and a band portion, the band portion wrapping around the seal.

* * * * *